United States Patent [19]

George et al.

[11] 4,029,123

[45] June 14, 1977

[54] PUMP TANK DIVIDER PLATE FOR SUMP SUCTION SODIUM PUMPS

[75] Inventors: John A. George, Greensburg; Donald R. Nixon, Murrysville, both of Pa.

[73] Assignee: The United States of America as represented by the United States Energy Research and Development Administration, Washington, D.C.

[22] Filed: Aug. 20, 1975

[21] Appl. No.: 606,043

[52] U.S. Cl. ..... 137/565; 417/424

[51] Int. Cl.[2] ..... F04D 9/02; F04D 13/16

[58] Field of Search ..... 137/565, 568; 417/424; 176/38

[56] References Cited

UNITED STATES PATENTS 1,736,002 11/1929 Frickey et al. ..... 417/424

*Primary Examiner*—William R. Cline

*Attorney, Agent, or Firm*—Dean E. Carlson; Kenneth L. Cage

[57] ABSTRACT

A circular plate extends across the diameter of "sump suction" pump, with a close clearance between the edge of the plate and the wall of the pump tank. The plate is located above the pump impeller, inlet and outlet flow nozzles but below the sodium free surface and effectively divides the pump tank into two separate chambers. On change of pump speed, the close fitting flow restriction plate limits the rate of flow into or out of the upper chamber, thereby minimizing the rate of level change in the tank and permitting time for the pump cover gas pressure to be varied to maintain an essentially constant level.

4 Claims, 3 Drawing Figures

PUMP TANK DIVIDER PLATE FOR SUMP SUCTION SODIUM PUMPS

BACKGROUND OF THE INVENTION

The present invention was made or conceived in the course of, or under, a contract with the United States Energy Research and Development Administration.

FIELD OF THE INVENTION

This invention relates to pumps and particularly to sump suction sodium pump assemblies for a liquid metal fast breeder reactor which minimizes the rate of level change in the tank and permits time for the pump cover gas pressure to be varied to maintain an essentially constant level.

DESCRIPTION OF THE PRIOR ART

Large capacity, main systems liquid metal circulating pumps are mechanical, centrifugal free surface pumps. The term "free surface pump" implies that a liquid metal free surface level, as sodium, potassium or the like, exists in the pump tank. Two basic pump types exist. The "piped suction" where the inlet flow is internally piped within the pump tank to impeller and the impeller discharges back into the pump tank; and the "sump suction" pump where the impeller takes its suction from the sump (the pump tank) and the discharge flow is internally piped.

In piped suction pump assemblies, since the pump tank is exposed to the pump discharge pressure, the high pressure fluid is confined to a lower plenum with leakage flow from this plenum to the low pressure upper pump tank. The free surface level in the upper tank is maintained by returning this bypass, leakage flow back to the system by means of an external piping system. In this pump type, a pump tank divider plate, or its equivalent in the form of close fitting hydraulic internals, is an accepted design feature and is mandatory due to the pressure differential between pump discharge pressure and the permissible pressure in the upper pump tank. The pressure in the upper pump tank of the piped suction pump is low due to the fact that the inert cover gas above the sodium free surface must be sealed by the rotating shaft seal and that this cover gas pressure is normally equivalent to the suction side pressure on the pump to prevent sodium being forced out of the pump tank when the pump is stationary. U.S. Pat. No. 3,467,015 issued to H. G. Allen on Mar. 28, 1968 described features of a piped suction pump.

In the sump suction concept, the entire pump tank is at suction pressure. The pump discharge flow is internally piped within the pump tank in this concept, and bypass or leakage is automatically returned to the sump and impeller inlet, eliminating an external return system. The sump suction concept readily accommodates a double suction impeller, as opposed to the piped suction concept where internal piping would have to be ducted to both sides of the impeller. FIG. 1 illustrates a prior art sump suction pump. With a double suction impeller, for a given system available NPSH (Net Pump Suction Head), the impeller can be operated at a higher speed, permitting a reduction in pump diameter and costs. Alternatively, with a double suction impeller, the required NPSH of the pump can be reduced, reducing the extent to which the system has to be pressurized to prevent cavitation and thereby improving plant safety in the event of a rupture type accident.

The major disadvantages of the sump suction concept, however, is pump tank level "draw down". As shown in FIG. 1 with a balanced, interconnected cover gas system throughout the sodium loop 100 and a constant free surface level A in the reactor vessel 104 having a core 106, the draw down in level C in pump tank 108 from the variable free surface level B in the pump tank 108 will be equal to the friction head loss between the reactor vessel 104 and the pump 112. This friction loss must be accommodated by an increased length of pump shaft 114 to keep the impeller 116 submerged. Under representative, commercial Liquid Metal Fast Breeder Reactor (LMFBR) operating conditions, with the pump assembly 112 in a hot leg piping location 118 (not shown), this friction head loss or draw down would be about 5–6 feet. For a cold leg piping pump location 120, draw down can be as much as 60 ft., thereby severely limiting the cold leg applications of this pump assembly type. Other adverse effects of this draw down phenomenon concern transient changes in all free surface levels (as A and B) through the system, with possible thermal shock to container walls, on changes in pump speed. The magnitude of these phenomenon can best be appreciated by comparing the liquid metal pump size with the size of a six foot man as illustrated in FIG. 2. This magnitude of pump size is also illustrated at Page 1786 of the "Hearings" before the Joint Committee on Atomic Energy, 93rd Congress, 1st Session on Civilian Reactor Development, Part 3, March 14, 1973.

SUMMARY OF THE INVENTION

Accordingly, it is a primary object of this invention to provide a new and improved sump suction pump.

It is a further object of this invention to provide a sump suction pump assembly which eliminates pump tank level draw down.

It is a further object of this invention to provide a sump suction pump assembly which prevents gas entrainment from the free surface liquid metal level due to vortexing in the pump tank.

It is still a further object of this invention to provide a sump suction pump assembly which enhances in the reactor system, level control and stability by imposing a flow restriction between interconnected free surface volumes.

Another object of this invention is to provide a sump suction pump assembly which enhances reactor safety with pressurized cover gas systems by restricting the rate at which sodium can flow to or from free surface volumes in the event of an individual cover gas system malfunction.

Yet, another object of this invention is to provide a sump suction pump assembly which even without differential pressure control prevents gas entrainment from the free surface level due to vortexing in the pump tank.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the sump suction pump assembly of this invention comprises a generally cylindrical casing open at one end, the casing having a discharge nozzle and a suction nozzle formed therein, a main flange means covering the open end of the casing and means cooperating with the casing and flange means to form an enclosed pump tank, the main flange means having a generally cylindrical neck extending through the flange means into the pump tank, a rotatable shaft extending through the flange means and the neck, an impeller attached to the inward end of the shaft and positioned generally in the path between the suction nozzle and the discharge nozzle, a shaft bearing assembly fixedly secured to the structural member in said enclosed space and rotatably receiving such shaft, means positioned across the pump tank and cylindrical neck to divide the pump tank into two separate chambers, whereby on change of pump speed the divider means limits the rate of fluid flow into or out of the upper chamber.

Preferably, the means is positioned above the impeller, discharge and suction nozzles but below the free surface liquid metal level.

It is also preferred, that the divider means positioned across the pump tank and cylindrical tank and cylindrical neck comprises a closely fitting divider plate.

It is further preferred that the divider means across the pump tank and cylindrical neck comprises a plurality of spaced-apart plates each having a plurality of openings in staggered alignment to each other to define an orifice.

BRIEF DESCRIPTION OF THE DRAWINGS

The invention consists in the novel parts, constructions, arrangements, combinations and improvements shown and described. The accompanying drawings, which are incorporated in and consititute a part of this specification, illustrate one embodiment of the invention and, together with the description, serve to explain the principles of the invention.

DESCRIPTION OF THE PREFERRED EMBODIMENT

Figure 2:
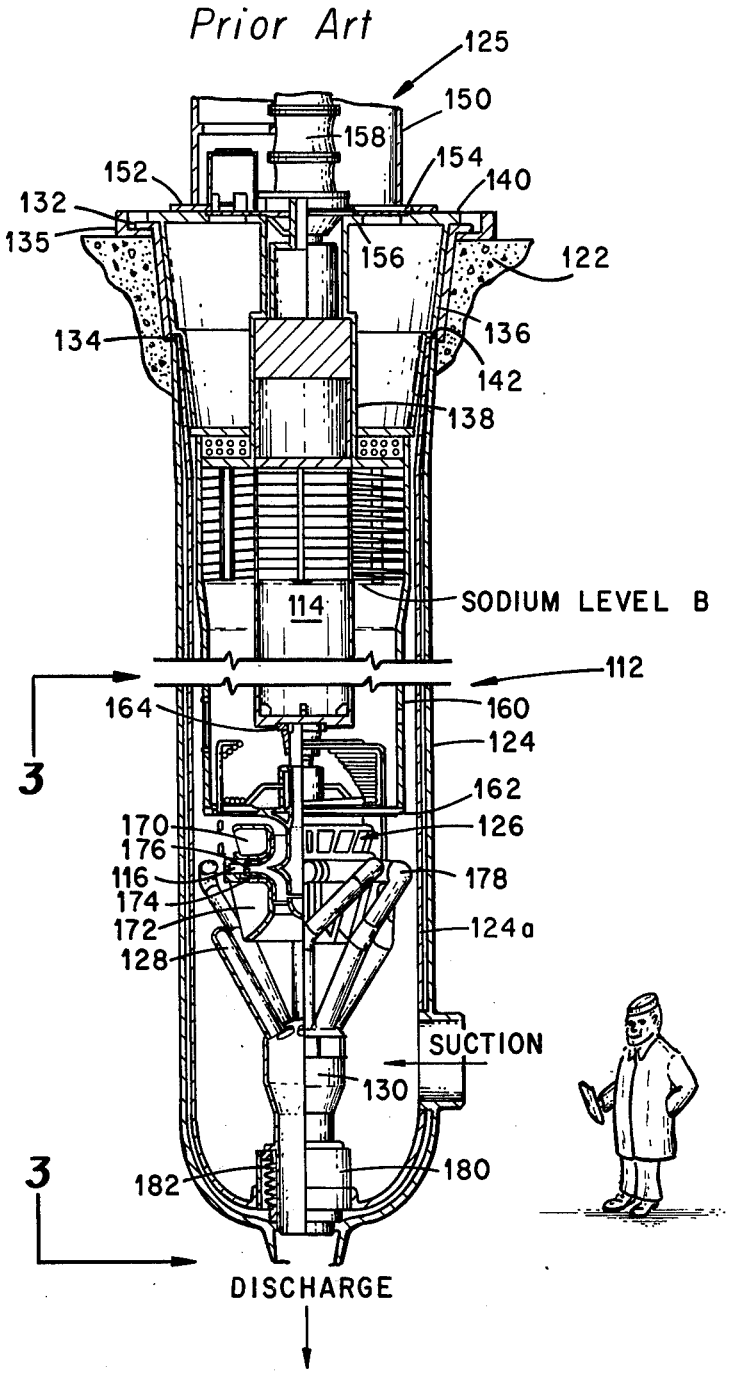
FIG. 2 is a vertical sectional view of a prior art sump suction pump assembly.

Reference will now be made in detail to the present preferred embodiment of the invention, an example of which is illustrated in the accompanying drawings. For better understanding of pump, reactor and heat exchanger details, and piping arrangements of liquid metal reactors, reference is made to U.S. Pat. application Ser. No. 363,697 filed by Johnson et al. on May 24, 1973, now U.S. Pat. No. 3,956,063. Referring now to FIG. 2, the sump suction pump assembly 112 shown therein comprises a supporting structure 122, a generally cylindrical tank 124 and tank liner **124*a*, a motor support 125, a centrifugal sump suction pump 126, suction openings 170 and 172, a plurality of discharge headers 128 which form into the pipe discharge passage 130 and the pump shaft 114**.

In the present drawing, the supporting structure 122 is illustrated as a concrete deck. The supporting structure may be at the floor of a building or may be a structural steel framework capable of supporting the sump suction pump assembly. As shown the tank 124 has an outwardly extending flange 132 and a shoulder 134 which rests on an annular ring 135 of the concrete of the deck supporting structure 122, thereby suspending the tank from the supporting structure. A plug comprising a metal container 136, which is of a gate pen shape having a tubular sleeve 138 extending vertically through the central portion of the container, is mounted at the top of supporting structure 122 by means of a flange 140 and a shoulder 142 on the container. The flange 140 rests on the flange 132 of the tank and the shoulder 142 may rest on the shoulder 134 of the tank 124. The container 136 may be filled with concrete or other suitable material.

A motor base 150 has a flange 152 which rests on a cover plate 154 which, in turn, rests on the flange 140 at the outer rim of the container 136, and a flange 156 on the tubular sleeve 138 of the container. A seal 158, which may be of a suitable type, surrounds the shaft 114 and is mounted on the flange 156. The pump component 126 is suspended from the motor support 125 by means of a cylindrical sleeve 160 which may be formed integrally with or secured to the bottom of the container 136 by welding or other suitable means. A pump supporting ring 162 is secured to the lower end of the sleeve 160 by welding. A radial bearing assembly 164 is provided for the pump shaft 114. The bearing assembly 164 may be of any suitable type and is attached to the ring 162 by bolts (not shown) or other suitable means.

Figure 1:
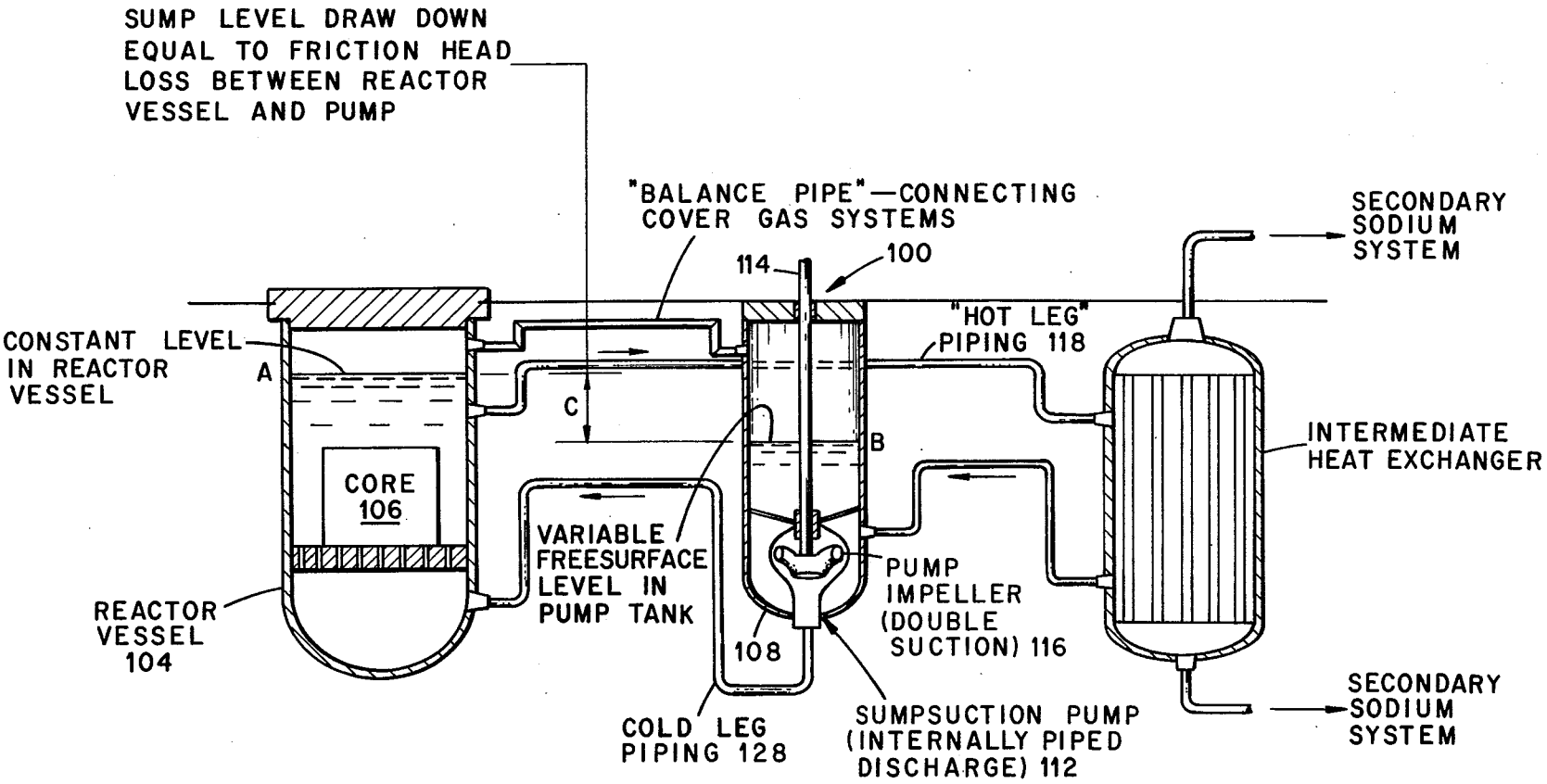
FIG. 1 is a schematic representation of a sump suction pump assembly in the primary loop of a liquid metal fast breeder reactor.

The pump component comprises the impeller 116, upper and lower suction openings 170 and 172 respectively, and a vaned casing 174. The impeller 116 shown in FIG. 1 is of a dual suction, radial flow blade type. The casing discharge passages or nozzles 176 remove the fluid radial velocity from the diffuser and direct the flow into the plurality of discharge headers 128 spaced around the casing.

Figure 3:
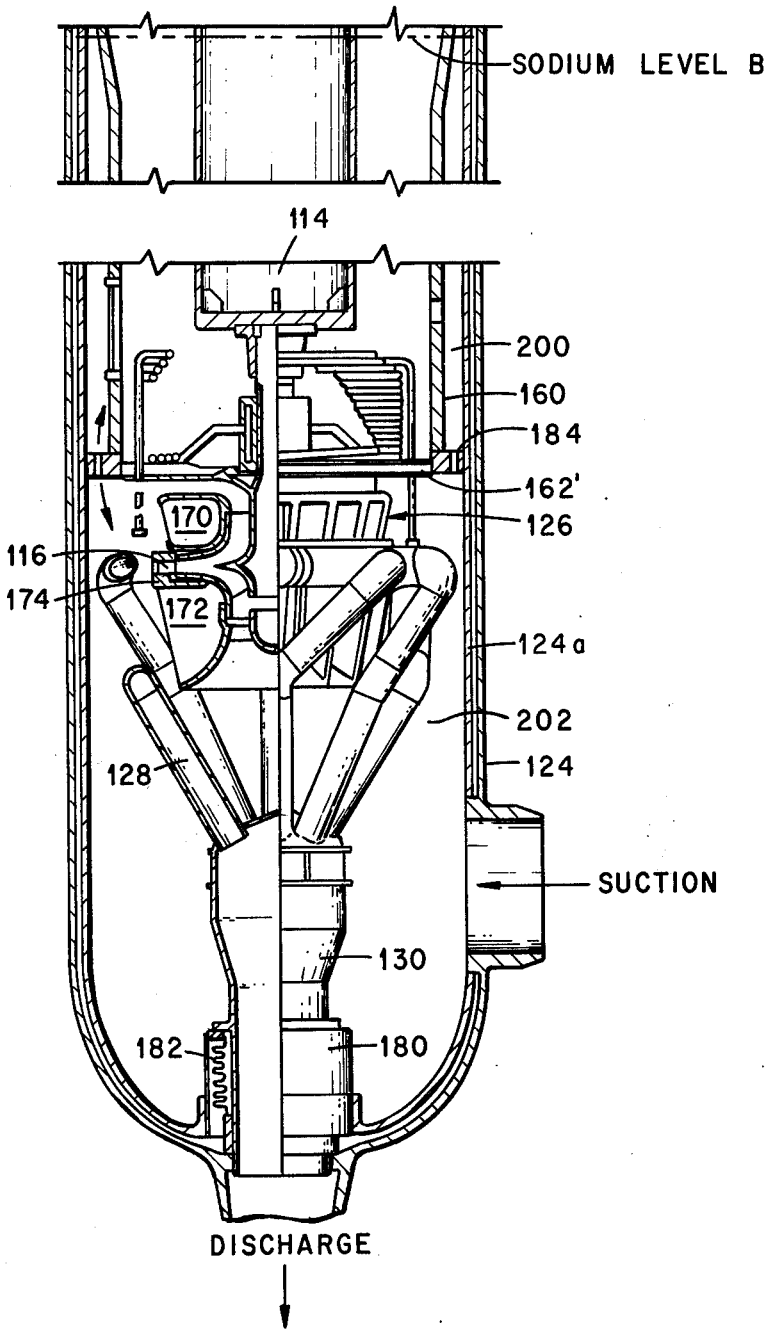
FIG. 3 is a vertical sectional view of a sump suction pump assembly of area 3—3 of FIG. 2 which embodies features of the present invention.

The headers 128 have an inlet opening 178 with a generally vertically extending cylindrical passageway which terminates to exit passage 130 connected to a cylindrical discharge adapter 180, having a vertical disposed wall. The adapter 180 has a bellows type seal 182 to provide for expansion and contraction differentials incurred during temperature excursions. The nose piece on the lower end of the bellows seats on a shoulder on the tank. In accordance with the invention, the sump suction type pump assembly includes the division of the pump tank 124 of the sump suction pump into two separate chambers 200 and 202 with a high resistance to flow from one chamber to the other. As best illustrated in FIG. 3, the division of the pump tank is above the impeller and nozzles but below the liquid metal free surface level. By extending a chamber division means as a closely fitting divider plate 184 across the pump tank 124, above the impeller 116, but below the free surface level B FIG. 3, it is possible to significantly reduce the rate of level change in the pump tank 124 with change in pump speed.

Preferably, the actual percentage of the area in the diameter of the pump tank 124 to be restricted by the divider plate 184 is a function of the diameter of the pump tank, the extent to which level changes can be tolerated, the rate of pump speed or flow, the rate at which cover gas pressure could be varied and the type of clearance between the divider plate and the pump tank (i.e. a plane annular gap as opposed to a labyrinth type "seal").

As here embodied and as best seen in FIG. 3, a closely fitted divider plate is defined to cover the cross sectional area in the pump tank by at least 90%. If desired, the cross-sectional area can be reduced by as much as 99% and thereby allow fluid flow through only one percent of the original cross sectional area. By combining this feature with local control of the cover gas pressure in the pump tank itself, it is possible to maintain an essentially constant level in the pump tank over the entire operating range.

In accordance with the invention, there are many alternate means of achieving control of the rate of level change, as for example internal barrels, seals, closely fitting hydraulic internals or the like. Preferably a plurality of spaced-apart plates each having a plurality of openings in staggered alignment to each other to form an orifice covering an area in the pump tank from 90 to 99 percent, and could also be utilized for flow resistance between the chambers 200 and 202.

As here embodied in this invention and as best shown in FIG. 1, assume a representative system friction loss from reactor outlet to pump inlet (cold leg location) of 15 psi at full flow. Assume the cover gas pressure above the constant free surface level in the reactor is maintained at 18 psig throughout the operating range. The cover gas pressure above the free surface level in the pump tank is separately controlled on level to maintain a constant level. At zero flow conditions, the level in the reactor vessel will be equal to the level in the pump tank and both cover gas systems will be at the same pressure of 18 psig. As flow is increased, the level in the pump tank will start to fall. However, the close fitting divider plate 184 will limit the rate of draw down and allow the cover gas pressure in the pump tank to readjust and maintain a constant level. At full flow conditions, both free surface level at 18 psig but the pressure in the pump tank will be close to atmospheric at 3 psig. If either gas system should malfunction, the divider plate will sufficiently restrict the rate of level changes in the system so that the reactor and pumps can be stripped and the respective gas systems vented to atmosphere before loss of flow, loss of submergence of flooding can occur.

The invention provides improved sump suction pumps which eliminates pump tank draw down, prevents gas entrainment on the free surface liquid metal level, and enhances safety, level control and stability.

Thus, it is apparent that there has been provided, in accordance with the invention, a pump assembly that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

We claim:

1. A centrifugal sump suction fluid pump assembly including a generally cylindrical casing open at one end, said casing having a discharge nozzle and a suction inlet formed therein, a main flange means covering the open end of said casing and means cooperating with said casing and flange means to form an enclosed pump tank adapted to maintain fluid therein at a predetermined free surface level, said main flange means having a generally cylindrical neck extending through said flange means having a generally cylindrical neck extending through said flange means into said pump tank, a rotatable shaft extending through said flange means and said neck, an impeller attached to the inward end of said shaft and positioned generally in the path between said suction inlet and said discharge nozzle, a shaft bearing assembly fixedly secured to a structural member in said enclosed space and rotatably receiving such shaft, means having openings positioned across said pump tank and cylindrical neck to divide the pump tank into an upper chamber containing the free surface of said fluid and a lower chamber containing said impeller of said pump whereby on change of pump speed said divider means limits the rate of fluid flow between said lower chamber and said upper chamber.

2. The assembly defined in claim 1, wherein said divider means positioned across said pump tank and cylindrical neck comprises a closely fitting divider plate.

3. In a liquid pumping system comprising:

an enclosed, elongated, vertically oriented pump tank provided with a liquid inlet passageway; and a centrifugal sump suction pump mounted within said pump tank, said pump having a discharge passageway extending outside said tank, and a suction inlet communicating with the interior of said pump tank, the improvement comprising means dividing the interior of said pump tank into an upper zone and a lower zone, said means positioned above said suction inlet ad adapted to restrict fluid flow between said upper and lower zones, and said liquid inlet passageway to said pump tank being in fluid communication with said lower zone.

4. The system of claim 3 wherein said means dividing the interior of said pump tank into an upper zone and a lower zone comprises a closely fitting divider plate.

* * * * *